US008314669B2

(12) United States Patent
Botsch

(10) Patent No.: US 8,314,669 B2
(45) Date of Patent: Nov. 20, 2012

(54) ELECTROMECHANICAL CONNECTION SYSTEM

(75) Inventor: Axel Botsch, Heidenheim (DE)

(73) Assignee: Rosenberger Hochfrequenztechnik GmbH & Co. KG, Fridolfing (DE)

( * ) Notice: Subject to any disclaimer, the term of this patent is extended or adjusted under 35 U.S.C. 154(b) by 55 days.

(21) Appl. No.: 13/123,376

(22) PCT Filed: Oct. 12, 2009

(86) PCT No.: PCT/EP2009/063266

§ 371 (c)(1),
(2), (4) Date: Apr. 8, 2011

(87) PCT Pub. No.: WO2010/043585

PCT Pub. Date: Apr. 22, 2010

(65) Prior Publication Data

US 2011/0193667 A1 Aug. 11, 2011

(30) Foreign Application Priority Data

Oct. 14, 2008 (DE) ..... 10 2008 051 183

(51) Int. Cl.
*H01H 9/00* (2006.01)
*H01R 11/30* (2006.01)
*H01R 13/60* (2006.01)

(52) U.S. Cl. ..... 335/177; 335/136; 335/165; 335/170; 335/178; 335/179; 335/166; 335/205; 335/206; 335/207; 439/1; 439/38; 439/39; 439/40

(58) Field of Classification Search ..... 335/136, 335/165, 170, 177–179, 166, 205–207; 439/1, 439/38–40

See application file for complete search history.

(56) References Cited

U.S. PATENT DOCUMENTS

| | | | | |
|---|---|---|---|---|
| 2,573,920 | A * | 11/1951 | McLeod | 200/51.09 |
| 4,317,969 | A * | 3/1982 | Riegler et al. | 200/52 R |
| 5,921,783 | A * | 7/1999 | Fritsch et al. | 439/38 |
| 6,231,349 | B1 | 5/2001 | Bullinger et al. | |
| 6,623,276 | B2 * | 9/2003 | Dalmau Ferrerfabrega et al. | 439/39 |
| 6,897,370 | B2 * | 5/2005 | Kondo et al. | 136/243 |
| 6,966,781 | B1 * | 11/2005 | Bullinger et al. | 439/38 |

FOREIGN PATENT DOCUMENTS

| | | |
|---|---|---|
| DE | 296 15 005 U1 | 1/1997 |
| EP | 0 573 471 B1 | 12/1993 |
| EP | 0 922 315 B1 | 6/1999 |
| WO | 92/16002 | 9/1992 |
| WO | 98/09346 | 3/1998 |

* cited by examiner

*Primary Examiner* — Mohamad Musleh
(74) *Attorney, Agent, or Firm* — GrayRobinson, P.A.

(57) ABSTRACT

An electromechanical connection system having a current supply device connectable to a current source through current supply contacts. The current supply device has with switching magnets on a magnet carriage. A current collection device has a release magnet and can be electrically connected to a load is connectable to the current supply device. A safety magnet is restored to a rest position by a retaining magnet or a ferromagnetic retaining part if the magnet carriage remains in a live state even if the current collection device is removed to effect short circuit. A non-conducting short-circuit part movably arranged in the current supply device between two short-circuit line parts, holds the safety magnet a distance from the short-circuit line under normal conditions. The non-conducting short-circuit part connects the short-circuit line parts if the magnet carriage does not return responsive to removal of the current collection device.

10 Claims, 8 Drawing Sheets

ELECTROMECHANICAL CONNECTION SYSTEM

CROSS REFERENCE TO RELATED APPLICATIONS

This application claims priority under 35 U.S.C. Sections 119(a)-(d), 120, 363 and 365 to International Patent Application No. PCT/EP2009/063266, filed Oct. 12, 2009 which designated the United States and at least one other country in addition to the United States and claimed priority to German Application No. 10 2008 051 183.8 filed Oct. 14, 2008. Both PCT/EP2009/063266 and German Application No. 10 2008 051 183.8 are expressly incorporated by reference herein in their entirety to form a part of the present disclosure.

FIELD OF THE INVENTION

The invention relates to an electromechanical connection system having a current supply device which can be connected to a current source via current supply contacts and is provided with switching magnets arranged on a magnet carriage, and having a current output device, which has tripping magnets and can be electrically connected to a load, and by means of which current output device the switching magnets can be moved from a rest position to a working position against a restraining force, wherein the switching magnets interact by means of a specific magnetic coding of the magnet poles with the tripping magnets, which are arranged in the current output device, in order to provide specific magnetic fields for the switching process, wherein at least one securing part is arranged in the current supply device and has a securing magnet which interacts with a short-circuit line, wherein the securing magnet is moved back to the rest position by a restraint magnet or by a ferromagnetic restraint part when the magnet carriage remains in the electrically connected state when the current output device is removed, resulting in a deliberate short circuit.

BACKGROUND OF THE INVENTION

A connection system of the type mentioned initially is known from EP 0 922 315 B1. In the case of the already known apparatus, a securing part was provided for the electromechanical connection between a switching device or a current supply device and a current output device which can be connected thereto, while ensuring that the current to the contact elements is nevertheless interrupted, in order to prevent electrical accidents, even in extreme situations in which, for example, the magnet carriage is stuck in the electrically connected position, which means that current and voltage are present on the exposed contact elements. For this purpose, a securing device with a securing part in the form of a securing magnet is arranged in the switching device or current supply device such that, if the magnet carriage does not return to its rest position, in which no current flows through the contact elements, a deliberate short circuit is produced simply by the securing magnet returning to the rest position. In this case, the securing magnet is moved with a rotation in a helical shape in the direction of the rest position in order to produce the short circuit in this rotated position.

SUMMARY OF THE INVENTION

The present invention is based on the object of improving even further the already known electrical connection apparatus or the connection system, in particular by simplifying the physical design while nevertheless still providing reliable operation.

According to the invention, a non-conductive short-circuit part is now used which limits the movement of the securing magnet during normal operation and allows the securing magnet to move further only if the magnet carriage does not return, with a short-circuit connection then being produced at the end of this further movement.

The movable short-circuit part can therefore assume different positions to be precise such that, for example, appropriate positioning of the short-circuit part prevents a complete return movement of the securing magnet by means of a lock or blocking position, when the magnet carriage is located in the rest position during correct operation. However, if the magnet carriage does not return, this lock is released, and is then no longer present. In this case, the further movement of the securing magnet is no longer blocked, and it can make a deliberate connection to a short-circuit line in its final position.

In one highly advantageous embodiment of the securing device, a blocking device which is connected to the magnet carriage can limit the displacement movement of the short-circuit part.

In this case, the magnet carriage on which the contact elements and the switching magnets are arranged also carries out a short-circuit function in addition to its switching function, to be precise such that, during normal operation, the blocking position for the short-circuit part also limits the return movement of the securing magnet, which is thus held at a distance from the short-circuit line parts.

However, if the magnet carriage does not return, the blocking device does not become effective because of the lack of the magnet carriage as a result of which both the movement of the short-circuit part and the return movement of the securing magnet are not limited, and the deliberate short circuit is made by a connection to the short-circuit line parts.

The blocking device can be designed in various ways. All that is necessary is to design it such that it is ineffective during normal operation of the magnet carriage and unblocks or does not block the short-circuit part only if the magnet carriage does not return.

The blocking device can be provided in a simple manner with at least one toggle lever, which is used as a stop for the short-circuit part and therefore also for the securing magnet, and which can be operated by the magnet carriage.

When the magnet carriage returns to its rest position, it then operates the toggle lever or levers, which is or are therefore moved to a blocking position in order to limit the movement of the short-circuit part.

The deliberate connection to the short-circuit line parts can be produced by the securing magnet itself, which appropriately bridges a gap between the two line parts or else advantageously, as a simple design refinement, by means of an electrically conductive sleeve, composed of brass by way of example, which surrounds the securing magnet.

In a further advantageous refinement of the invention, the short-circuit part may have a bolt or a pin which can be moved axially in a hole or aperture in the magnet carriage.

This means that only a simple linear displacement of the short-circuit part is required. This is the case in particular when the short-circuit part can be moved in the magnet carriage in a hole which is formed centrally, as a result of which the magnet carriage at the same time also acts as a guide for the bolt.

The invention is highly advantageous not only for relatively high electrical voltages above 50 volts, for safety reasons, but also for situations in which, although the voltage is less than a direct-contact securing voltage, very high currents nevertheless flow. This is the case, for example, for connecting plugs for charging processes, for example, for charging of electric cars, hybrid batteries and similar apparatuses and appliances.

BRIEF DESCRIPTION OF THE DRAWINGS

Advantageous developments and refinements will become evident from the further dependent claims and from the exemplary embodiment which is described in the following text with reference to the drawing, in which:

DETAILED DESCRIPTION OF THE INVENTION

Figure 1:
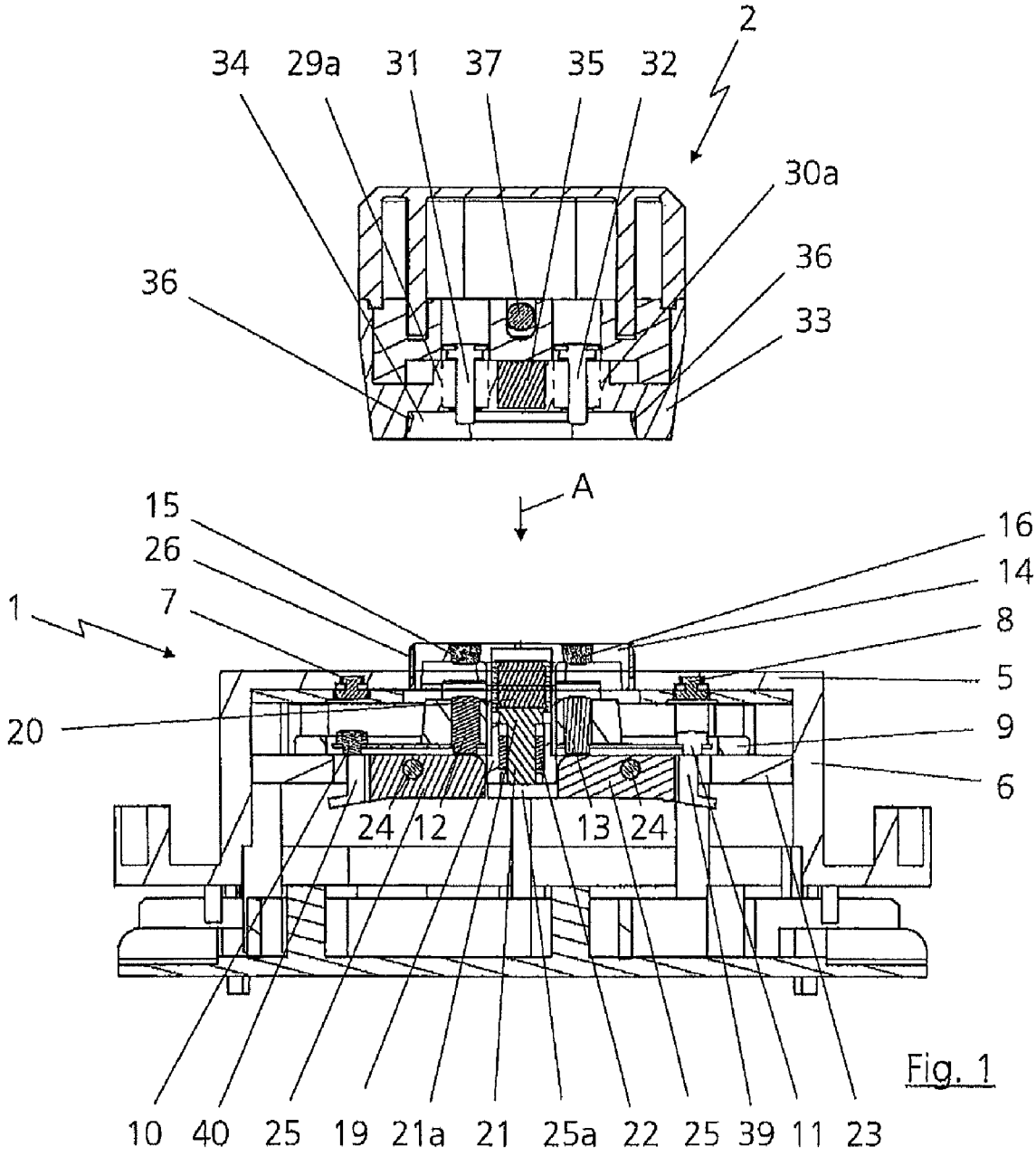
FIG. 1 shows the connection system according to the invention, with a longitudinal section through a current supply device and a current output device in stage 1.

The electromechanical connection system, as explained in the following text, is in principle of known design, for which reason only those parts which are essential to the invention will be described in more detail in the following text. With regard to the general design and method of operation, reference is made to EP 0 922 315 B1 and EP 0 573 471 B1. For this reason, these two documents likewise form a disclosure content of the present application.

The electromechanical connection system consists of a current supply device 1, which acts as a switching device, and a current output device 2, which is connected to an electrical consumer or load. As soon as an electrically conductive connection is made between the current supply device 1 and the current output device 2, the respective load which is connected to the current output device 2 is appropriately supplied with current. For this purpose, the current supply device 1 has current supply lines 3, 4 (see FIGS. 6 and 7), which can be connected via supply lines, which are not illustrated in any more detail, to contact members 7, 8 (see FIGS. 1-5), which are arranged on the inside of a housing wall 5, which faces the current output device 2, of a housing 6 of the current supply device 1.

The magnet carriage 9 is provided with contact elements 12, 13 which are connected via connection lines to contact points 10, 11 on the magnet carriage 9. The contact points 10, 11 are in mirror-image form or aligned with respect to the contact members 7, 8, which are arranged on the inside of the housing wall 5.

Blade contact elements 15, 16 are provided in a projection 14 on the housing wall 5, on its outside facing the current output device 2. When the magnet carriage 9 is in its activated position, in which the contact members 7, 8 rest on the contact points 10, 11 (see FIG. 4), the contact elements 12, 13 then also rest on the inside on the blade contact elements 15, 16, which are in this way then connected to the current supply lines 3, 4.

The magnet carriage 9 has a central hole 19 in whose interior a securing magnet 20 and a non-conductive short-circuit part 21, for example composed of plastic, can be moved in the axial direction.

The short-circuit part 21 is in the form of a bolt or pin with a cylindrical shape, having a head part 21*a* with a large diameter. A sleeve 22 composed of a ferromagnetic material is arranged around the shank of the bolt 21, in order that the securing magnet 20 can be attracted by the short-circuit part 21.

As can be seen from the figures, the short-circuit part 21 is located behind the securing magnet 20 in the hole 19 on the side facing away from the current output device 2.

An intermediate wall in the current supply device 1 forms a stationary holding plate 23 as a stop or rest for the magnet carriage 9. The holding plate 23 may consist of a ferromagnetic material, or a magnet. Alternatively, a ferromagnetic plate or a plurality of ferromagnetic parts can also be arranged on the holding plate 23. This refinement results in a restraint device or a restraint part for the magnet carriage 9 in the rest state, that is to say when the current output device 2 is not in contact, the magnet carriage 9 is attracted by magnetic forces to the holding plate 23, and rests on it.

As can also be seen from the figures, the axial hole 19 also extends through the holding plate 23.

Two mutually opposite toggle levers 25 are arranged via shafts or journals 24 in the holding plate 23 such that they can pivot.

Extensions 25*a*, which are used as stops for the short-circuit part 21, are located on the sides of the two toggle levers 25 facing the short-circuit part 21. Only one extension 25*a* can be seen in the sections shown in FIGS. 1 to 5. Both toggle levers 25 can be seen, with their extensions 25*a*, in FIGS. 6 and 9.

In addition to the two contact elements 15, 16, a grounding line 26 is also arranged externally on the circumferential wall, in the projection 14, which is preferably circular. The grounding line 26 may extend over the entire circumference or else only over a part as is illustrated in FIG. 7 (see the flattened areas at the side in the projection). The grounding line 26 is connected in a manner which is not illustrated in any more detail to a grounding supply line 44 (see FIGS. 6 and 7).

Figure 9:
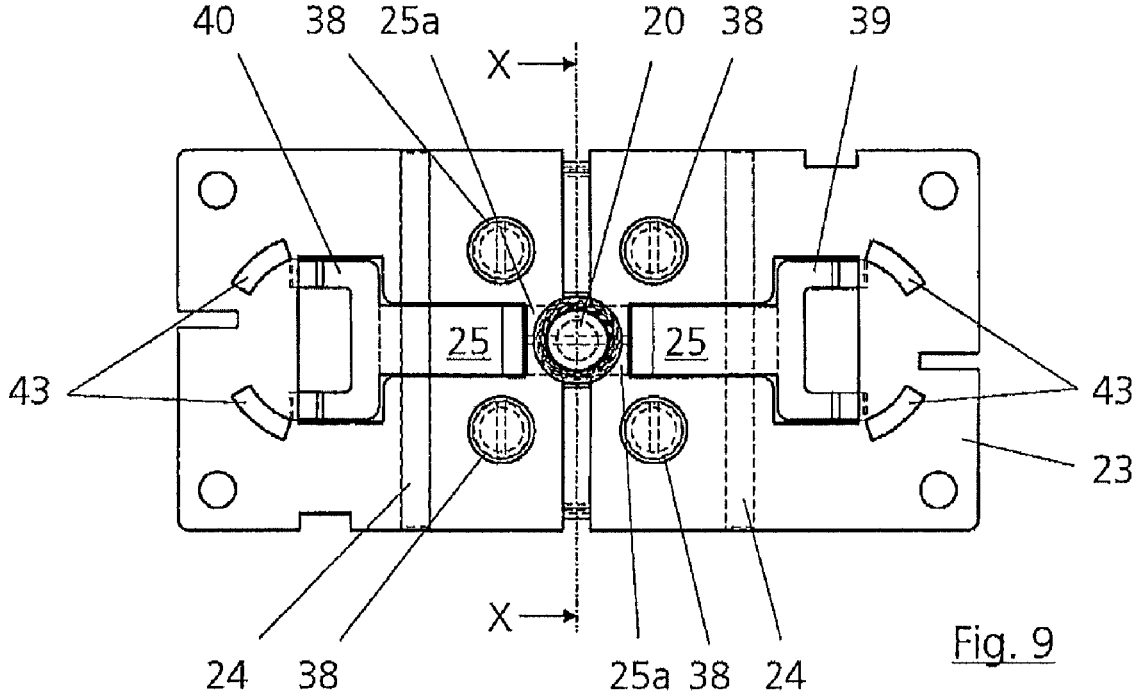
FIG. 9 shows a plan view of the securing device.

Coded switching magnets 27*a*, 27*b* and 28*a*, 28*b* are arranged in or on the magnet carriage 9 (see FIGS. 7 and 9). The magnetic coding results from the association of the respective poles of the four tripping magnets 27*a*, 27*b* and 28*a*, 28*b* which are illustrated by way of example in the exemplary embodiment, for example with the tripping magnets 27*a* and 27*b* each having a south pole on the side facing the current output device 2, and the tripping magnets 28*a* and 28*b* each having a north pole, as a result of which a magnetic effect is created only when oppositely magnetically coded tripping magnets 29*a*, 29*b* and 30*a*, 30*b* are approached by opposite poles in the current output device 2 of the current supply device.

For clarity reasons, the tripping magnets 29*a* and 30*a* are illustrated by dashed lines only in FIG. 1. The switching magnets and the tripping magnets can therefore be arranged in mirror-image form with respect to one another for operation, in which case opposite poles must in each case have opposite polarity.

The current output device 2 is provided with contact pins 31, 32, whose diameters are matched to the diameter of the blade contact elements 15, 16.

The front end face 33, facing the current supply device 1, is provided with a circular recess 34, whose diameter is matched to the diameter of the projection 14. During connection of the current output device 2 to the current supply device 1, this results in rough mechanical guidance, in addition to a subsequent magnetic holding force for the connection between the current supply device 1 and the current output device 2, by means of the respective four switching magnets 27*a*, 27*b*, 28*a*, 28*b* and the tripping magnets 29*a*, 29*b*, 30*a*, 30*b*.

The magnetic forces can in this case be chosen such that the attraction forces of the tripping magnets 29*a*, 29*b*, 30*a*, 30*b* for the switching magnets 27*a*, 27*b*, 28*a*, 28*b* are greater than the restraining force produced by the ferromagnetic holding plate 23 and a ferromagnetic plate or parts which is or are placed on the holding plate.

An opposing magnet 35 is provided in the current output device 2, as an opposing piece for the securing magnet 20, arranged with the securing magnet 20, in the current output device 2, and therefore likewise in an axial hole. In contrast to the securing magnet 20, the opposing magnet 35 is, however, arranged to be stationary in the current output device 2. Grounding ring segments 36, which interact with the grounding ring segments 26 on the projection 14, are likewise located on the inner wall of the recess 34. The grounding ring segments 36 are connected in a manner which will not be described in any more detail to a grounding line 37, which leads to a load.

In order to allow the contact pins 31 and 32 of the current output device 2 to be connected over the complete area and securely to the contact elements 15 and 16, the front parts should project slightly beyond the rear wall of the recess 34, and should preferably be mounted in a sprung or elastic manner in the current output device 2.

Figure 8:
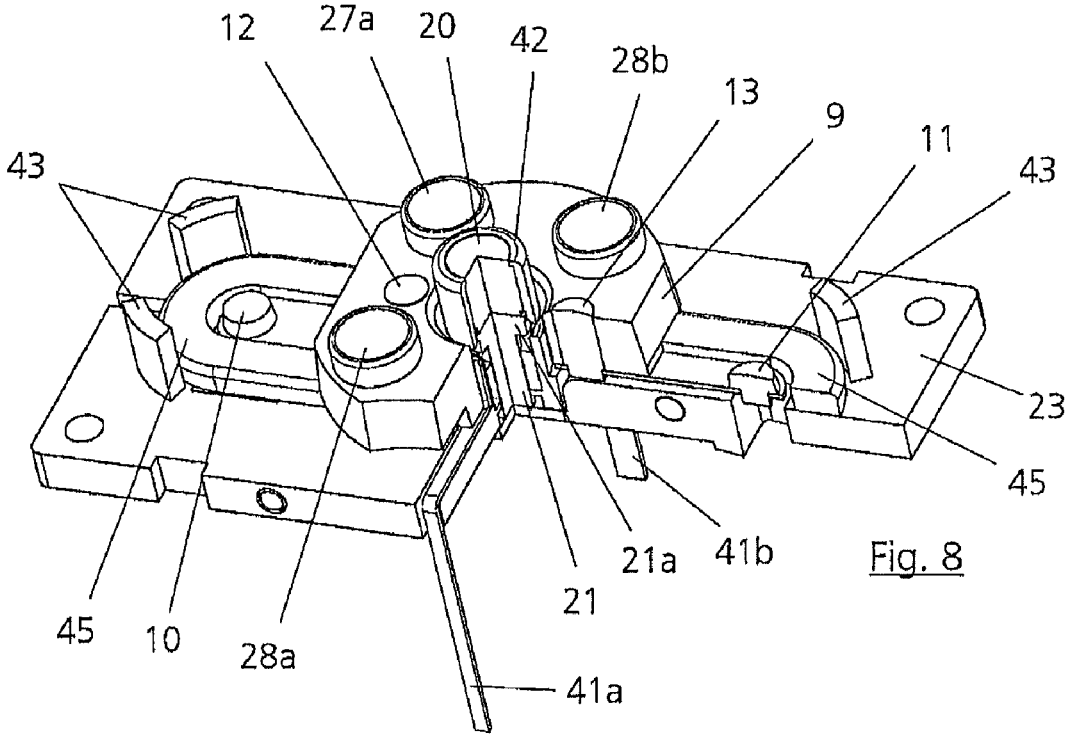
FIG. 8 shows a 3D view of a detail illustration of the magnet carriage with the short-circuit part of the securing device.

The 3D illustration in FIG. 8 shows the securing device with the short-circuit part 21 as a securing part, and the securing magnet 20. FIG. 8 also shows four circular segments 43, which are arranged on the holding plate 23 and represent a guide for the magnet carriage 9.

For this purpose, the magnet carriage 9 has a rounded area 45 at each of its side ends, via which the magnet carriage 9 is guided during its axial movement by the guide 43. At the same time, the rounded areas are also used to press the toggle lever 25 onto the rear ends 39 and 40 when the magnet carriage 9 returns to the rest position, in order that the front or inner extensions 25*a* of these toggle levers 25 cannot be pivoted downward or away from the front housing wall 5. FIG. 8 also shows the two short-circuit line parts 41*a* and 41*b*.

Figure 10:
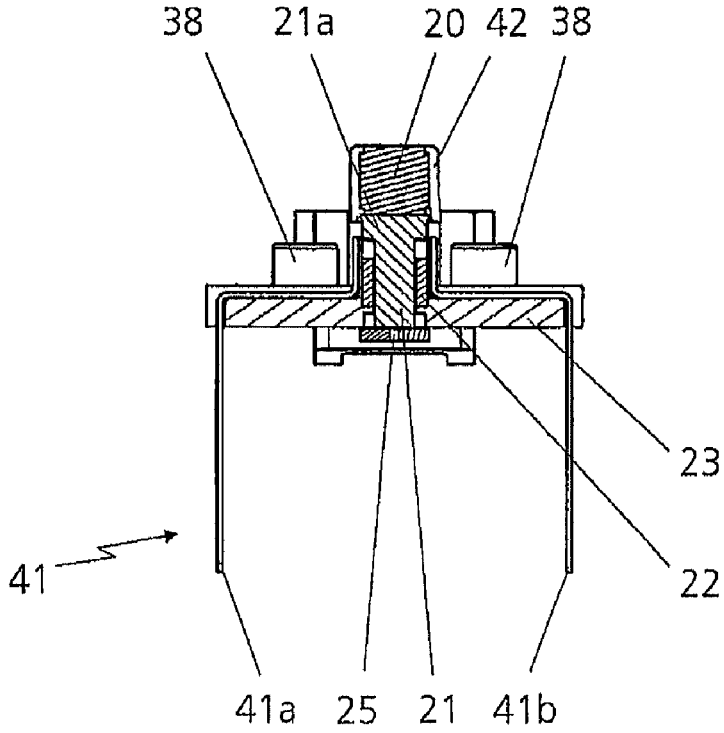
FIG. 10 shows a section along the line X-X as shown in FIG. 9.

In a separate illustration, FIGS. 9 and 10 show the securing device together with the holding plate 23.

As can also be seen from FIG. 9, the rear ends 39 and 40 of the toggle levers 25 are each only in the shape of a fork, for weight reasons. The rounded areas 45 of the magnet carriage 9 press against the forks.

As an embodiment of a ferromagnetic restraint part or restraint parts for interaction with the switching magnets 27*a*, 27*b*, 28*a*, 28*b* in their rest position, FIG. 9 shows four ferromagnetic restraint parts 38, which are arranged on the holding plate 23.

As can also be seen from FIG. 9, the ferromagnetic restraint parts 38 are in the form of screws or are provided with screws, which are screwed into corresponding threaded holes in the holding plate 23. In this way, the magnetic attraction force for the switching magnets 27*a*, 27*b*, 28*a*, 28*b* can be set exactly by appropriate adjustment of the screws, in order to achieve correct operation. The restraint force and/or the restraint/switching-point time are/is set by the distance between the restraint parts 38 and the switching magnets 27*a*, 27*b* in the magnet carriage 9.

The method of operation of the electromechanical connection system with the current supply device 1 and the current output device 2 will be explained in more detail in the following text.

Figure 2:
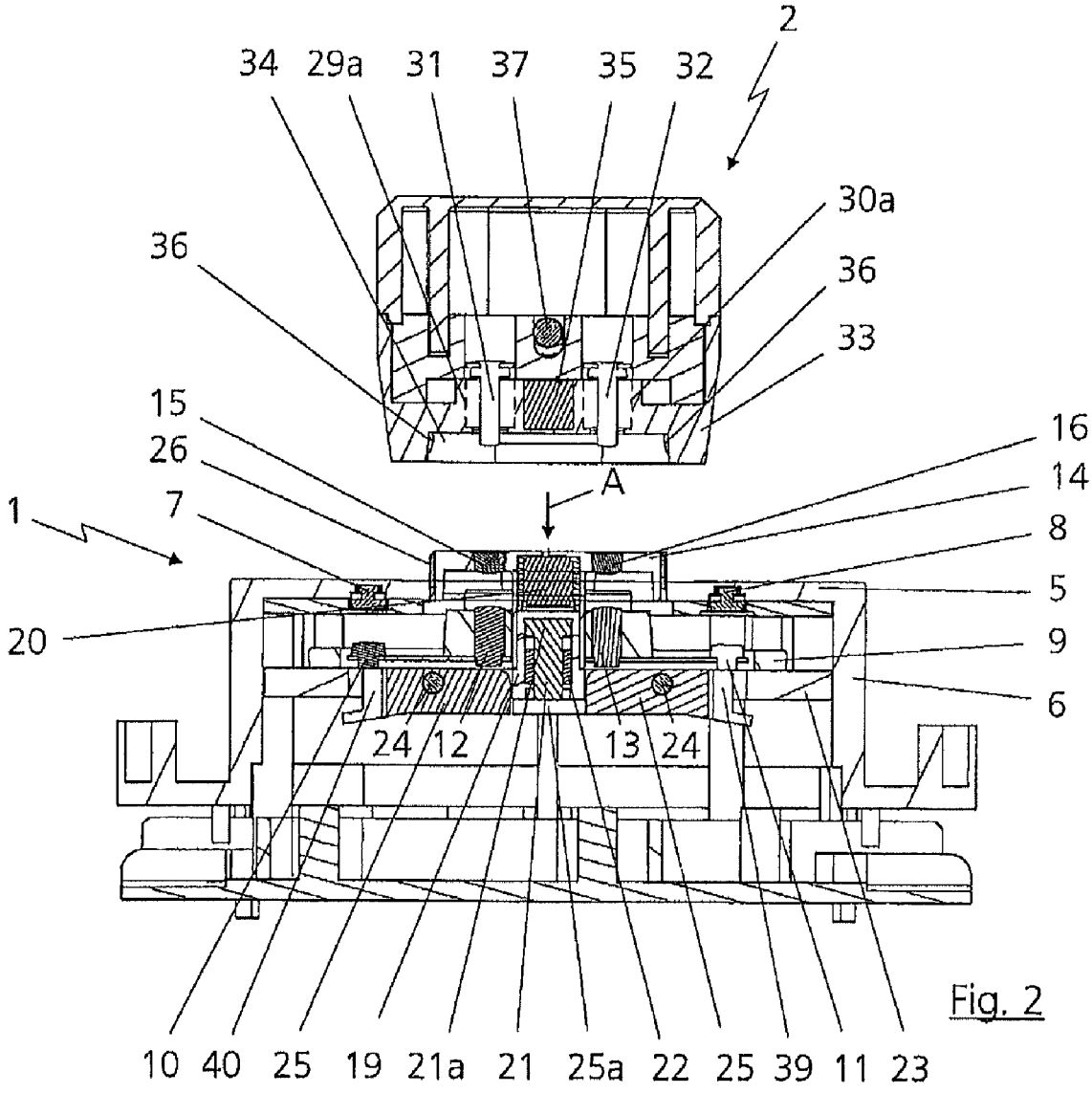
FIG. 2 shows the connection system illustrated in FIG. 1 with the current output device approaching the current supply device in stage 2.

Starting from FIG. 1, which shows the "rest state", in which there is no electrical contact connection between the contact elements 15 and 16 and the current supply lines 3 and 4, and the current output device 2 is approaching the current supply device 1, on the basis of the illustration shown in FIG. 2, for positioning of the magnet carriage 9 on the holding plate 23 on the basis of magnetic attraction. As can be seen, as a first part, the securing magnet 20 is attracted by the approaching opposing magnet 35, and is raised. The short-circuit part 21 can therefore also move in the axial direction. The two toggle levers 25 are held in a blocked position in their movement option both in FIG. 1 and in FIG. 2, because the magnet carriage 9 in each case presses onto the rear ends 39, 40 of the toggle levers 25, which face away from the extensions 25*a*, by virtue of its magnetic contact with the holding plate 23. In this way, the extensions 25*a* form stops for the short-circuit part 21, and therefore block the movement capability in a direction further away from the current output device 2.

Figure 3:
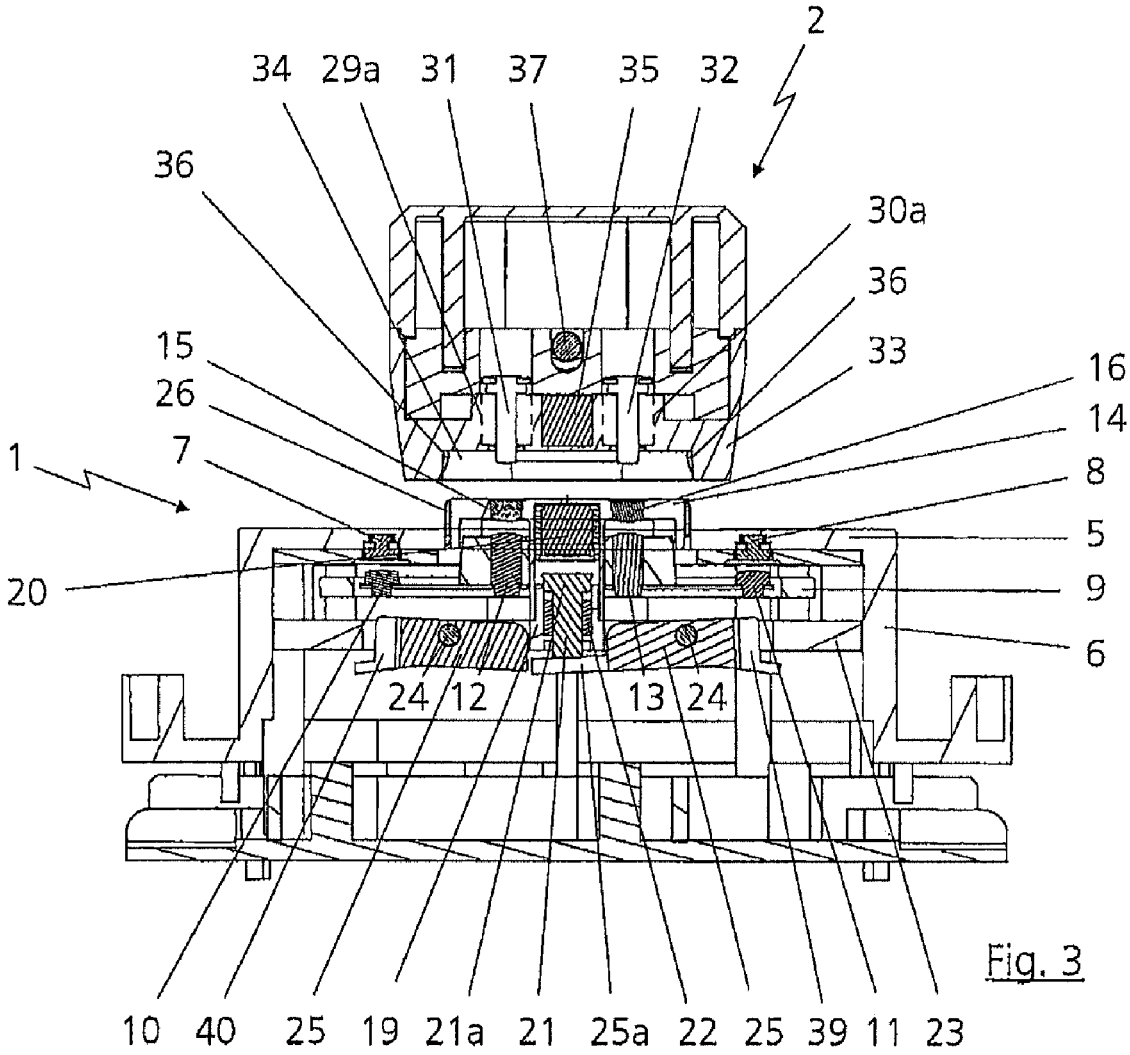
FIG. 3 shows the current output device shortly before the state when it makes contact with the current supply device in stage 3.

As can be seen from FIG. 3, as the current output device 2 approaches the current supply device 1 more closely, the magnet carriage 9 is also raised, with its contact points 10 and 11 making contact with the contact members 7 and 8 when the current output device 2 makes contact with the current supply device 1. This therefore results in an electrical connection to the contact pins 31 and 32 via the contact elements 12 and 13 and the contact elements 15 and 16, and therefore in an electrical connection to the current output device 2 for a load.

Figure 4:
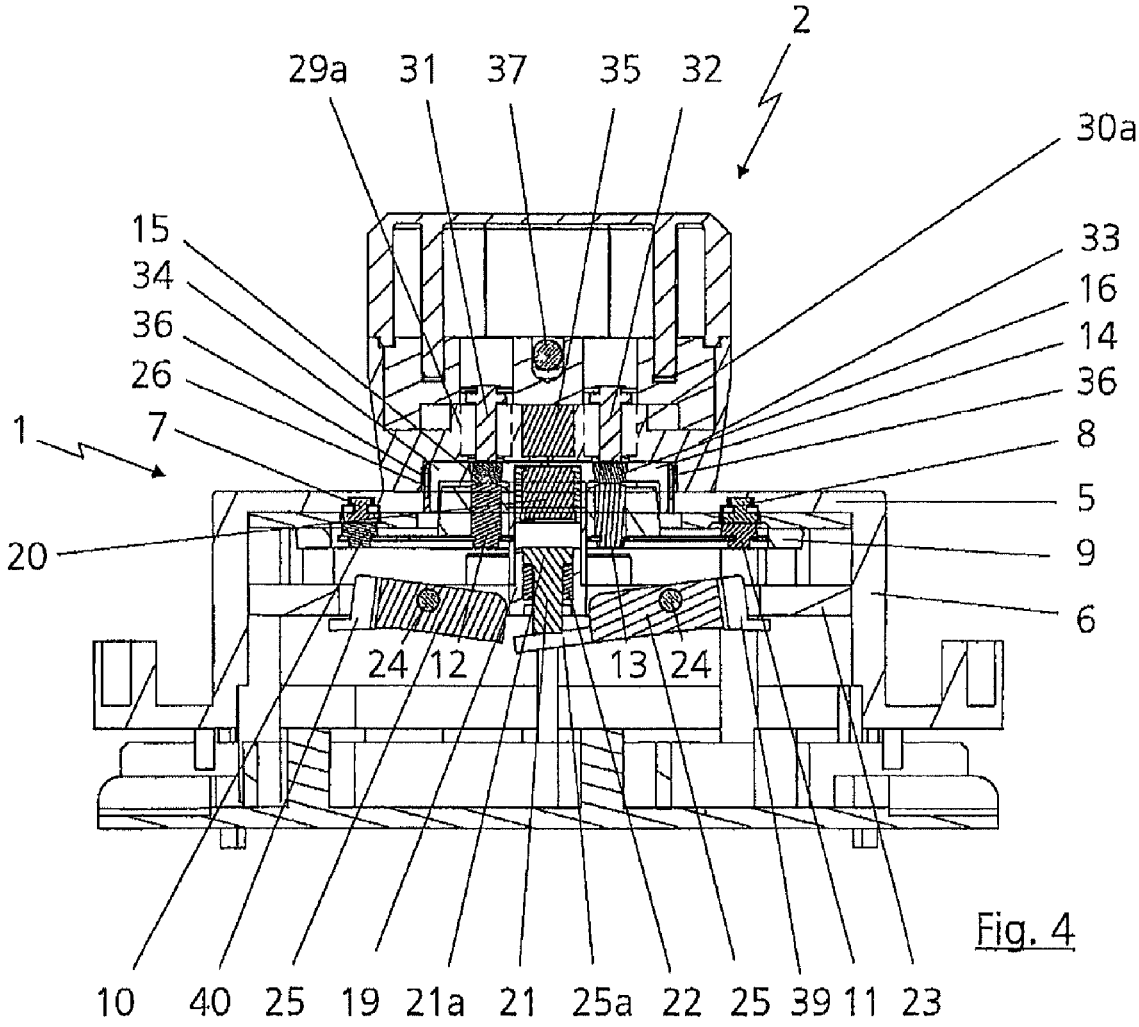
FIG. 4 shows the current supply device in contact with the current output device in stage 4.

As can be seen from FIG. 3, and in particular from FIG. 4, the securing magnet 20 is in contact with the opposing magnet 35, and the magnet carriage 9 rests on the inside of the housing wall 5. In this situation, the toggle levers 25 as well as the short-circuit part 21 can move freely, although their respective position is irrelevant.

When the current output device 2 is moved away from the current supply device 1 again, there is no attraction force for the switching magnets 27*a*, 27*b* and 28*a*, 28*b* because of the distance from the tripping magnets 29*a*, 29*b* and 30*a*, 30*b*, and they "fall back" onto the holding plate 23, or are magnetically attracted by it. This also applies to the securing magnet 20. In this normal method of operation, the magnet carriage 9 therefore returns to a state as illustrated in FIG. 1. During its return, however, it in each case presses onto the rear ends 39 and 40 of the toggle levers 25, as a result of which they are pivoted with their extensions 25*a* in the direction of the housing wall 5. As a result of this pivoting movement, the extensions return to a position as illustrated in FIG. 1, and thus form stops to limit the movement of the short-circuit part 21.

Figure 5:
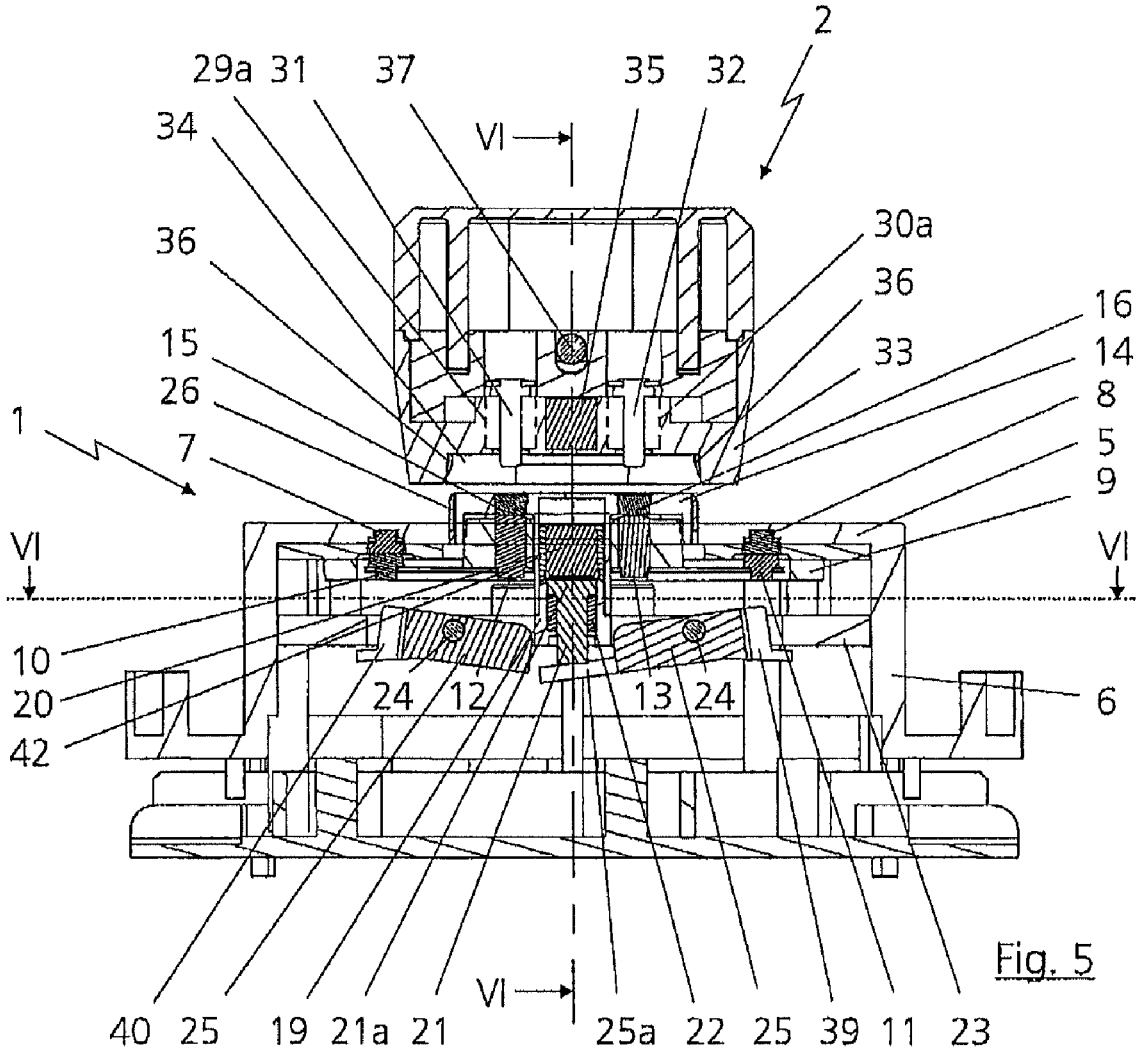
FIG. 5 shows a short-circuit position of the connection system via a securing magnet when the magnet carriage does not return to the rest position, as shown in FIG. 1.
Figure 6:
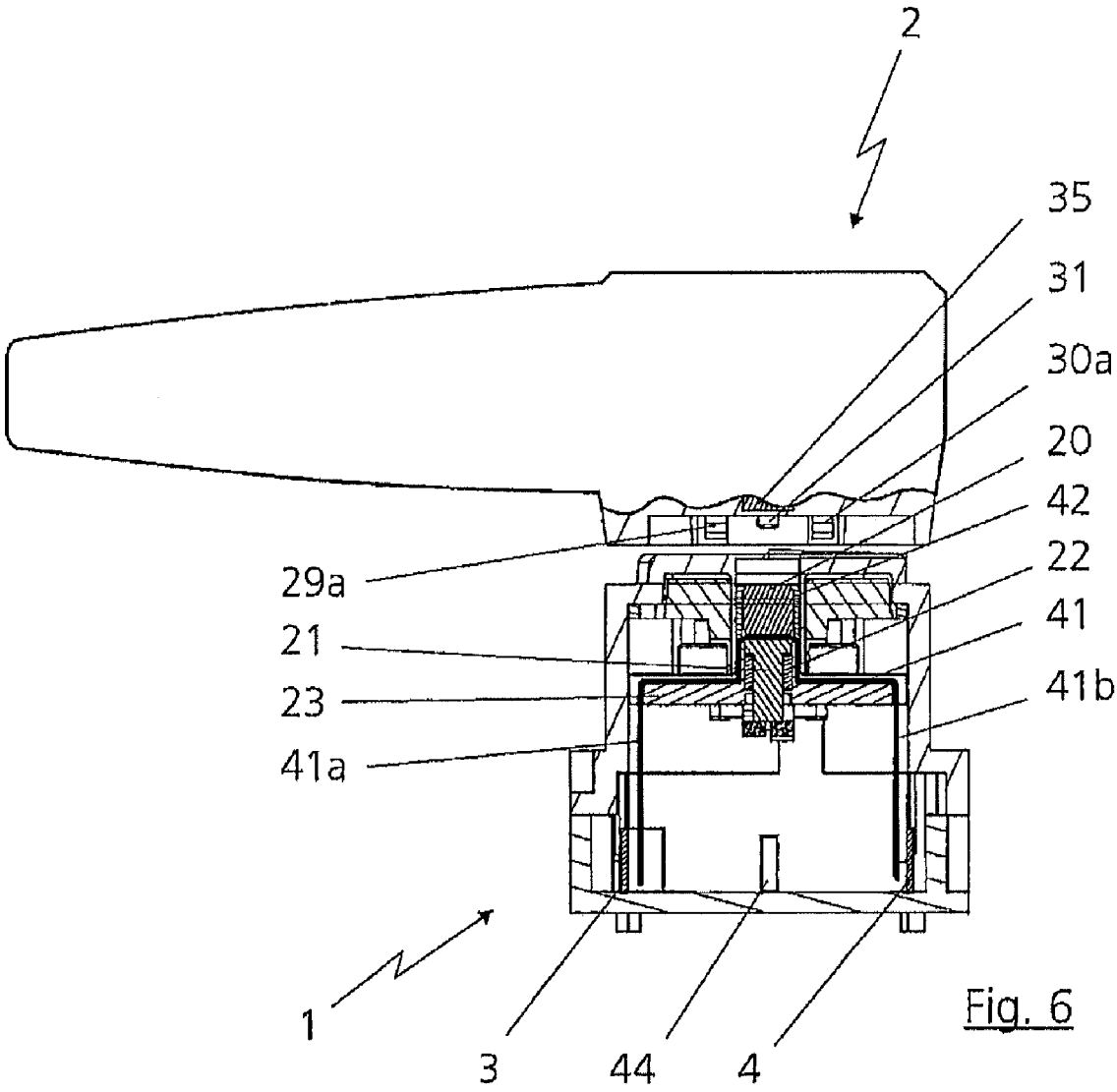
FIG. 6 shows a section along the line VI-VI in FIG. 5 in the short-circuit position with the current output device at a distance from the current supply.
Figure 7:
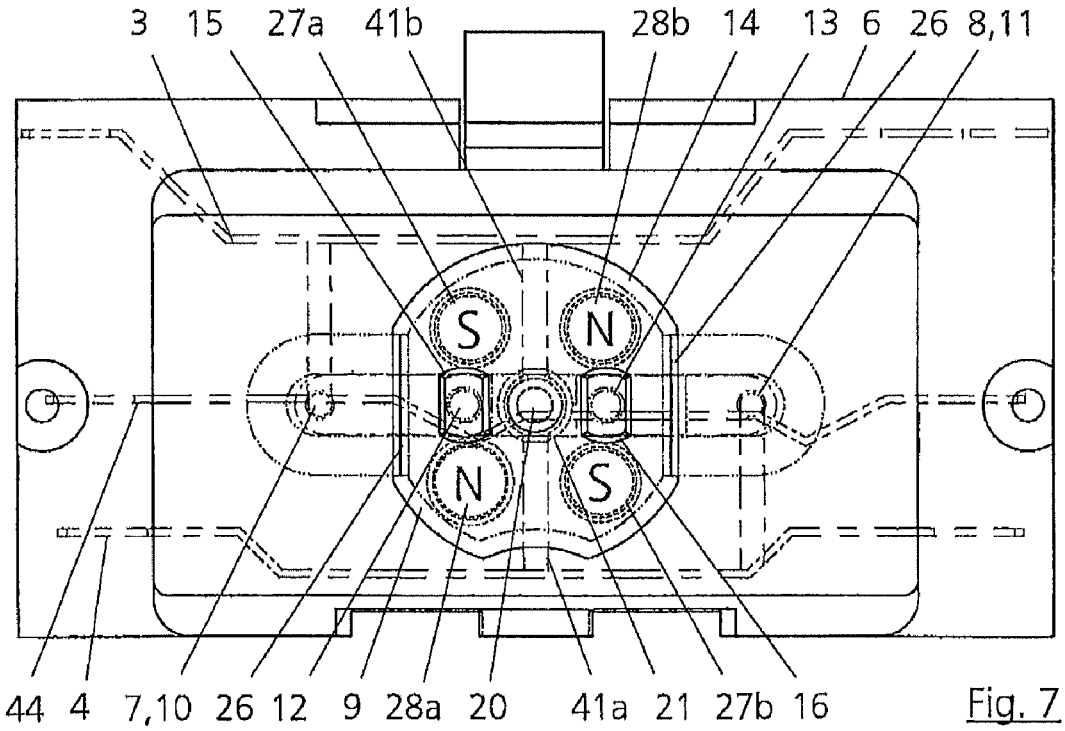
FIG. 7 shows a plan view of the end face of the current output device from the direction of the arrow A as shown in FIG. 1 (illustrated in enlarged)

FIGS. 5 and 6 show the method of operation which occurs when the magnet carriage 9 remains in its upper position for whatever reasons, despite the removal of the current output device 2, and therefore remains in a position in which it rests on the inner wall of the housing wall 5, as a result of which electricity would still be present on the contact elements 15 and 16, which are accessible from the outside.

As can be seen from FIGS. 5 and 6, the securing magnet 20 is, however, attracted by the ferromagnetic sleeve 22 on the short-circuit part, and both parts together are attracted by the holding plate 23, or the ferromagnetic part or parts arranged on the holding plate 23. However, because of the lack of the magnet carriage 9, the extensions 25*a* no longer form stops to limit the movement of the short-circuit part 21 and the securing magnet 20, since they can pivot away freely and are also pivoted away by the force of the securing magnet 20. This means that, in this case, the securing magnet 20 can enter the hole 19 more deeply, as can also be seen by comparing FIGS. 1 and 5.

The section views shown in FIGS. 6 and 10 show a short-circuit line 41 with short-circuit line parts 41*a* and 41*b*, which are connected to current supply contacts in the current supply device 1.

As can be seen from FIGS. 6 and 10, the short-circuit line parts 41*a* and 41*b* end in the holding plate 23, adjacent to the end face of the head part 21*a* of the short-circuit part 21. If, corresponding to the illustration shown in FIG. 5, the securing magnet 20 enters more deeply than normal because of the lack of a movement limit, then it comes into contact with the ends of the short-circuit line parts 41*a* and 41*b*, thus producing a bridge, and therefore a short-circuit connection.

This short-circuit connection may either be made directly through the lower or rear end face of the securing magnet 20 in its outer area, or by an electrically conductive sleeve 42, which surrounds the securing magnet 20.

While the invention has been described with reference to various preferred embodiments, it should be understood by those skilled in the art that various changes may be made and equivalents substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An electromechanical connection system having a current supply device which can be connected to a current source via current supply contacts and is provided with switching magnets arranged on a magnet carriage, and having a current output device, which has tripping magnets and can be electrically connected to a load, and by means of which the switching magnets can be moved from a rest position to a working position against a restraining force, wherein the switching magnets interact by means of a specific magnetic coding of the magnet poles with the tripping magnets, which are arranged in the current output device, in order to provide specific magnetic fields for the switching process, wherein at least one securing part is arranged in the current supply device and has a securing magnet which interacts with a short-circuit line, wherein the securing magnet is moved back to the rest position by a restraint magnet or ferromagnetic restraint parts when the magnet carriage remains in the electrically connected state when the current output device is removed, resulting in a deliberate short circuit, wherein a non-conductive short-circuit part, which is arranged in the current supply device such that it can be moved between two short-circuit line parts holds the securing magnet at a distance from the short-circuit line during normal operation, and produces a connection between the short-circuit line parts if the magnet carriage does not return when the current output device is removed.

2. The connection system as claimed in claim 1, wherein a blocking device which is connected to the magnet carriage limits the displacement movement of the short-circuit part.

3. The connection system as claimed in claim 2, wherein the blocking device is provided with at least one toggle lever which can be operated by the magnet carriage.

4. The connection system as claimed in claim 1, wherein the securing magnet is provided with an electrically conductive sleeve, via which the short-circuit line parts are connected.

5. The connection system as claimed in claim 1, wherein the short-circuit part has a bolt which can be moved axially in a hole or aperture in the magnet carriage.

6. The connection system as claimed in claim 5, wherein the hole is in the form of a central hole in the magnet carriage.

7. The connection system as claimed in claim 1, wherein a housing wall of the current supply device which faces the current output device is provided with a projection, into which a recess in an end wall of the current output device can be fitted.

8. The connection system as claimed in claim 7, wherein a circumferential wall of the projection is provided with a grounding ring or with grounding segments, which interacts or interact with a grounding ring or grounding segments which is or are arranged in the inner wall of the recess.

9. The connection system as claimed in claim 1, wherein the ferromagnetic restraint parts are arranged in or on a holding plate.

10. The connection system as claimed in claim 9, wherein the ferromagnetic restraint parts are in the form of screws, or are provided with screws.

* * * * *